US005813378A

United States Patent [19]

Sato

[11] Patent Number: 5,813,378

[45] Date of Patent: Sep. 29, 1998

[54] VALVE TIMING CONTROL DEVICE

[75] Inventor: Atsushi Sato, Kariya, Japan

[73] Assignee: Aisin Seiki Kabushiki Kaisha, Aichi-pref., Japan

[21] Appl. No.: 893,481

[22] Filed: Jul. 11, 1997

[30] Foreign Application Priority Data

Jul. 11, 1996 [JP] Japan ..... 8-182253

[51] Int. Cl.[6] ..... F01L 1/344

[52] U.S. Cl. ..... 123/90.17; 123/90.31; 74/568 R; 464/2; 464/160

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 4,858,572 | 8/1989 | Shirai et al. | 123/90.12 |
| 5,450,825 | 9/1995 | Geyer et al. | 123/90.17 |
| 5,535,705 | 7/1996 | Eguchi et al. | 123/90.17 |
| 5,558,053 | 9/1996 | Tortul | 123/90.31 |
| 5,588,404 | 12/1996 | Lichti et al. | 123/90.31 |
| 5,666,914 | 9/1997 | Ushida et al. | 123/90.17 |

FOREIGN PATENT DOCUMENTS 6-14403 2/1994 Japan .

*Primary Examiner*—Weillun Lo
*Attorney, Agent, or Firm*—Hazel & Thomas

[57] ABSTRACT

A valve timing control device includes a rotor fixed on a cam shaft and having a circular groove opposite an end surface of the cam shaft. The circular groove communicates with a passage formed in the cam shaft. A housing member is disposed so as to surround the rotor. An angular phase converting mechanism is disposed between the rotor and the housing member so as to be able to transmit the rotational torque from the housing member to the rotor and so as to be able to give the angular phase difference between the rotor and the housing member. A fluid supplying device supplies fluid under pressure to the angular phase converting mechanism through the passage and the circular groove.

10 Claims, 4 Drawing Sheets

VALVE TIMING CONTROL DEVICE

BACKGROUND OF THE INVENTION

1. Field of the Invention

The present invention relates to a valve timing control device and particularly to a valve timing control device for controlling an angular phase difference between a crank shaft of a combustion engine and a cam shaft of the combustion engine.

2. Description of the Prior Art

In general, valve timing of a combustion engine is determined by valve mechanisms driven by cam shafts according to a characteristic of the combustion engine or the particular use of the combustion engine. Since a condition of the combustion is changed in response to the rotational speed of the combustion engine, however, it is difficult to obtain an optimum valve timing through the whole rotational range. Therefore, a valve timing control device which is able to change a valve timing in response to the condition of the combustion engine has been proposed as an auxiliary mechanism of the valve mechanism in recent years.

A conventional device of this kind is disclosed, for example, in Japanese utility-model application laid-open publication No. 6(1994)-14403 or U.S. Pat. No. 4,858,572. In the former device, helical splines are formed both in a timing sprocket and in a cam shaft-side member which is fixed to an end of a cam shaft having on its axis a plurality of cams for opening and closing valves and projecting from a cylinder head of the combustion engine. The timing sprocket is driven by the rotational torque from a crank and is rotatably mounted on the cam shaft. In addition a piston provided with inner and outer circumferential helical splines for engaging the respective angular splines of the timing sprocket and the cam shaft-side member is disposed between the timing sprocket and the cam shaft-side member and transmits the rotational torque from the timing sprocket to the cam shaft-side member. Pressure chambers are formed at both sides of the piston between the timing sprocket and the camshaft-side member and the piston is axially moved by controlling the fluid pressure in the pressure chambers. At that point, the piston, the pressure chambers and respective angular splines of the timing sprocket and the cam shaft-side member function as an angular phase converting mechanism and an angular phase difference between the crank shaft (the timing sprocket) and the cam shaft is controlled.

On the other hand, the latter device includes a rotor which is fixed on the end of the cam shaft, a drive member driven by the rotational torque from the crank shaft and rotatably mounted on the cam shaft, a plurality of chambers that are defined between the drive member and the rotor, and a plurality of vanes that are mounted to the rotor and extend outwardly therefrom in the radial direction into the chambers so as to divide each of chambers into a first pressure chamber and a second pressure chamber. In this device, a fluid under pressure is supplied to a selected one of the first pressure chamber and the second pressure chamber. At that point, the vanes and the pressure chambers function as an angular phase converting mechanism and an angular phase difference between the crank shaft (the drive member) and the cam shaft is controlled.

In the above prior devices, passages for supplying the fluid to the pressure chambers are formed in the cam shaft. These passages have to be always communicating with the pressure chambers regardless of the angular phase difference between the crank shaft (the timing sprocket or the drive member) and the cam shaft. In order to maintain the communication between the passages and the pressure chambers, a circular groove through which communication is maintained between the pressure chambers and the passages is formed on the outer circumferential surface of the cam shaft-side member which the timing sprocket is rotatably fitted and the outer circumferential surface of the end of the cam shaft on which the rotor is fixedly fitted, respectively. However, according to these structures, the axial length of these fitting portions have to be made longer for preventing the fluid from leaking through the circular groove. As a result, the axial length of the end of the cam shaft which is projected from the cylinder head increases for ensuring the requisite sealing surface and thereby the size of the combustion engine is increased.

SUMMARY OF THE INVENTION

It is, therefore, an object of the present invention to provide an improved valve timing control device which overcomes the above drawback.

It is another object of the present invention to provide an improved valve timing control device which can prevent having to increase the size of the combustion engine when incorporating the device.

In order to achieve these objectives, there is provided an improved valve timing control device which includes a rotor fixed on a cam shaft and having a circular groove opposing to an end surface of the cam shaft, the circular groove communicating to a passage formed in the cam shaft, a housing member disposed so as to surround the rotor, an angular phase converting mechanism disposed between the rotor and the housing member so as to be able to transmit the rotational torque from the housing member to the rotor and so as to be able to give the angular phase difference between the rotor and the housing member and fluid supplying means for supplying fluid under pressure to the angular phase converting mechanism through the passage and the circular groove.

BRIEF DESCRIPTION OF THE DRAWINGS

Additional objects and advantages of the present invention will become more apparent from the following detailed description of preferred embodiments thereof when considered with reference to the attached drawing, in which.

DESCRIPTION OF THE PREFERRED EMBODIMENTS

A valve timing control device in accordance with preferred embodiments of the present invention will be described with reference to attached drawings.

Figure 1:
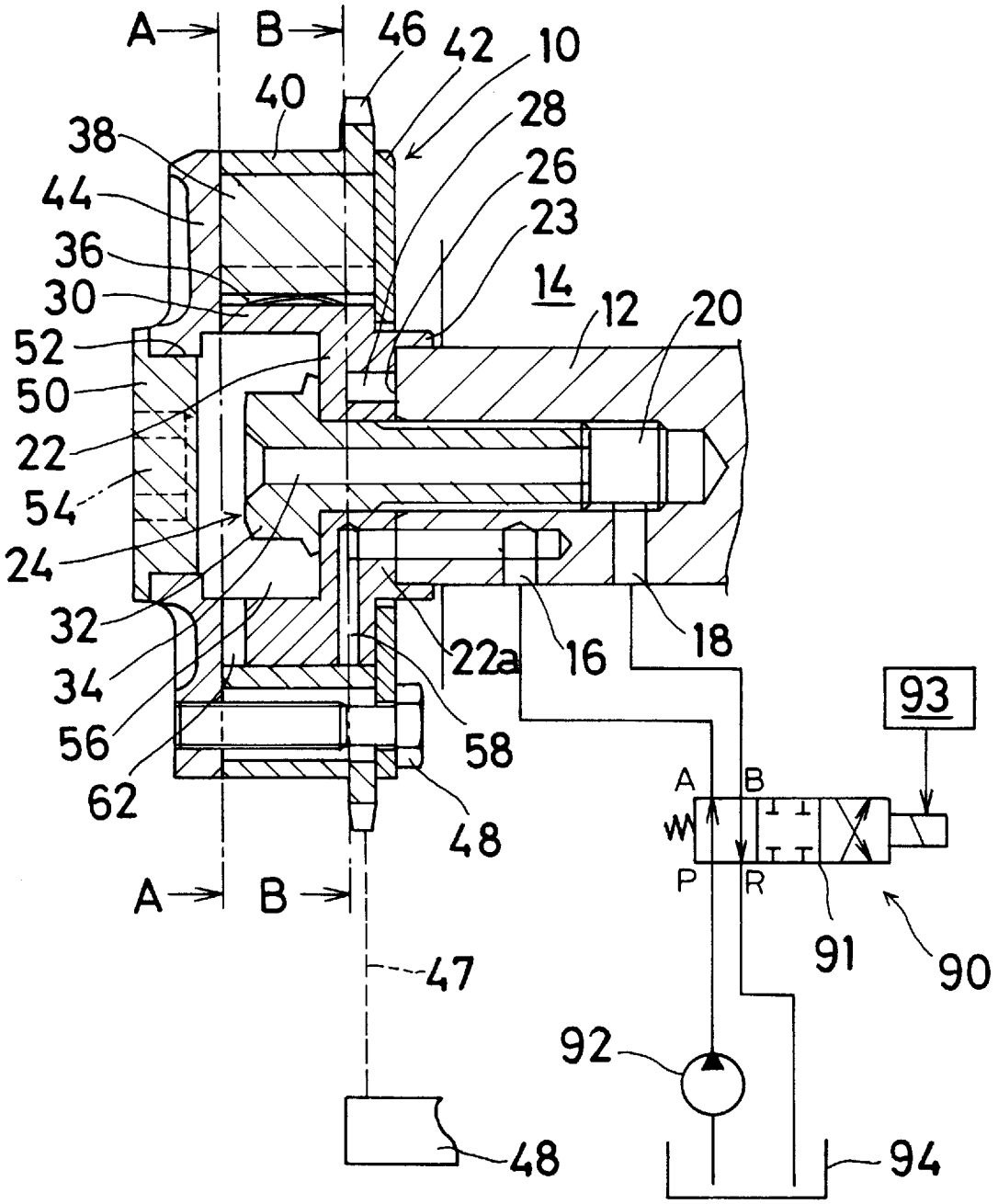
FIG. 1 shows a sectional view of an first embodiment of a valve timing control device in accordance with the present invention.
Figure 2:
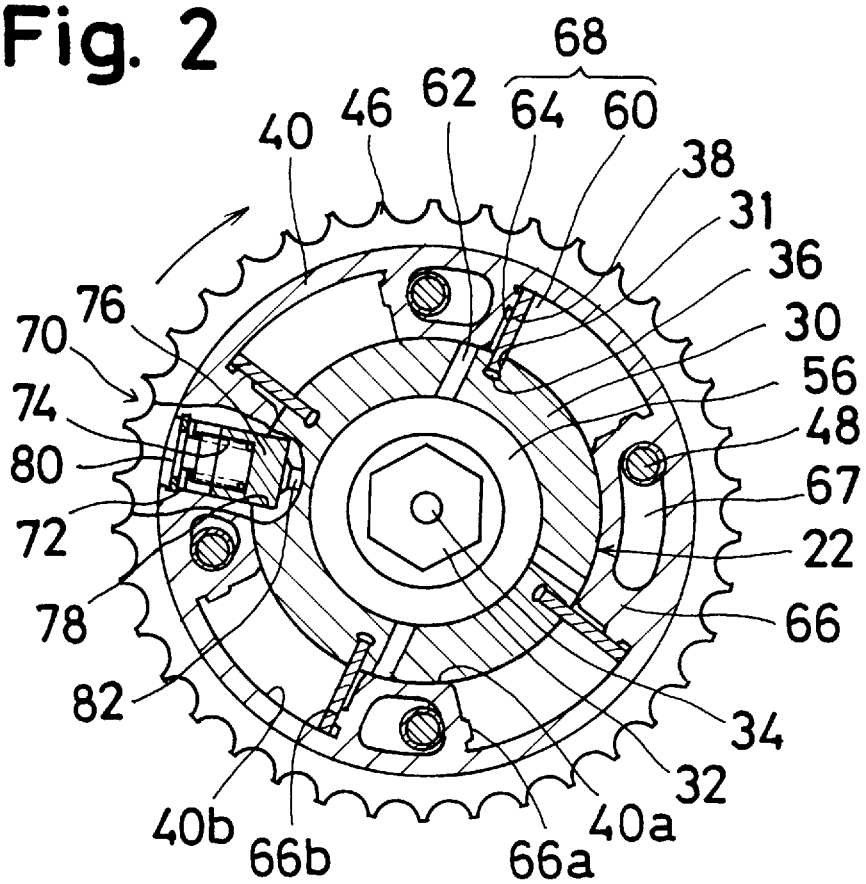
FIG. 2 shows a cross-sectional view taken on line A—A of FIG. 1.
Figure 3:
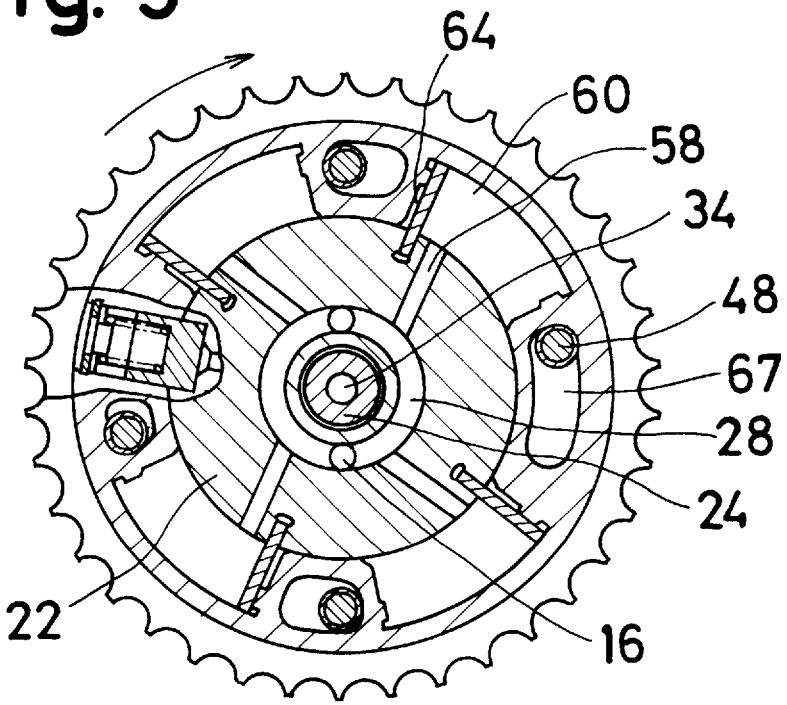
FIG. 3 shows a cross-sectional view taken on line B—B of FIG. 1.

FIGS. 1 to 3 show a first embodiment of the valve timing control device 10. Referring to FIG. 1, a cam shaft 12 that is provided with a plurality of cam portions (not shown) and driving valves (not shown) in rotatably supported on a cylinder head 14 of an engine at its plural journal portions (not shown). Passages 16, 18 are formed in the cam shaft 12 and the passage 18 communicates to a central hole 20 of the cam shaft 12.

An end of the cam shaft 12 is projected out of the cylinder head 14 and a rotor 22 is fixed to this projecting end of the cam shaft 12 by a bolt 24 which is screwed into the central hole 20. The rotor 22 has a flange portion 22*a* which is extended inwards in the radial direction and which is nipped between an end surface 26 of the cam shaft 12 and a head portion 32 of the bolt 24. On one surface of the flange portion 22*a* of the rotor 22 which is opposite to the end surface 26 of the cam shaft 12, a circular groove 28 is formed thereon and communicates with the passage 16. At one side of the flange portion 22*a,* a cylindrical projecting portion 23 in formed and is mounted on the projecting end of the cam shaft 12. At the other side of the flange portion 22*a,* a cylindrical portion 30 in which the head portion 32 of the bolt 24 is located is formed. The bolt 24 has a hole 34 which penetrates along the axial center and which communicates to the passage 18 through the central hole 20.

A cylindrical housing member 40 having a inner bore 40*a* is rotatably mounted on the outer circumferential surface of the cylindrical portion 30 of the rotor 22 so as to surround the rotor 22. The housing member 40 has the same axial length as the cylindrical portion 30 of the rotor 56 and is provided with five grooves 40*b* which are outwardly extended from the inner bore 40*a* in the radial direction and which are separated in the circumferential direction by partition wall portions 66 as shown in FIG. 2 and FIG. 3. Hollow portions 67 are formed in the partition wall portions 66 for decreasing the weight and inertial force of the housing member 40, respectively. The housing member 40 is further provided with three penetrating holes in the axial direction which are separated from each other at regular intervals. A gear portion 46 is formed on the housing member 40 and rotational torque is transmitted to the gear portion 46 (the housing 40) via a chain 47 from a crank shaft 48 of the engine.

A circular front plate 44 which in provided with four female screw holes in the axial direction is disposed adjacent to one side surfaces of the cylindrical portion 30 of the rotor 22 and the housing member 40 so as to be able to contact with both surfaces at its one side surface. A circular rear plate 42 provided with four penetrating holes in the axial direction is disposed adjacent to the other side surfaces of the cylindrical portion 30 of the rotor 22 and the housing member 40 so as to be able to contact with both surfaces at its one side surface. Each of the female holes of the front plate 44, each of the hollow portions 67 of the housing member 40 and each of the screw holes of the rear plate 42 are coaxially arranged with each other, and a bolt 48 is fitted into each of the coaxially arranged holes and hollow portions 67. Each of the bolts 48 is screwed into each of the female screw holes of the front plate 44. Thereby, the rotor 22, the housing member 40, the rear plate 42 and the front plate 60 are united. One side surface of the front plate 44 is fluid-tightly pressed onto one side surface of cylindrical portion 30 of the rotor 22 and the housing member 40 and one side surface of the rear plate 42 is fluid-tightly pressed onto the other side surfaces of the cylindrical portion 30 of the rotor 22 and the housing member 40. Now, a plug 54 is fluid-tightly fitted into a central opening of the front plate 44 and thereby a sealed space 56 which in communicated to the passage 18 is formed in the cylindrical portion 30 of the rotor 22.

Four pressure chambers 68 which are separated in the circumferential direction and each of which has a pair of circumferentially opposed walls 66*a,* 66*b* are defined among the rotor 22, the housing member 40, the front plate 44 and the rear plate 42. On the outer circumferential portion of the cylindrical portion 30 of the rotor 56, four grooves 31 which are extended inwardly therefrom in the radial direction and which are separated in the circumferential direction are formed thereon. Four vanes 38 which are extended outwardly in the radial direction into the chambers 68 are mounted in the grooves 31, respectively. Thereby, each of chambers 68 is divided into a first pressure chamber 60 and a second pressure chamber 64, both of which are fluid-tightly separated from each other. Each of the vanes 38 is normally urged outwards in the radial direction by a plate spring 36 which is disposed between each of the vanes 38 and the bottom surface of each of the grooves 31.

As shown in FIG. 2 and FIG. 3, the rotor 22 is provided with four first passages 58 and four second passages 62. One end of each of the first passages 58 is communicated with the circular groove 28 and the other end of each of the first passages 58 is communicated with each of the first pressure chambers 60. On the other hand, one end of each of the second passages 62 communicates with the space 56 and the other and of each of the second passages 62 communicates with each of the second pressure chambers 64.

A locking mechanism 70 for connecting the housing member 40 and the rotor 22 is disposed in the housing member 40. The locking mechanism 70 includes a piston pin 76 which is slidably fitted into a penetrating radial hole 72 formed in one of the partition wall portion 66. The outer end of the radial hole 72 is closed by a cover 80, and a spring 74 which urges the piston pin 76 inwardly is disposed between the cover 80 and the piston pin 76. In this embodiment, a fitting hole 78 communicating with the space 56 via a hole 82 is formed on the cylindrical portion 30 of the rotor 22 so that the piston pin 76 is fitted into the fitting hole 78 when the valve timing control device 10 is in the position of the maximum retarded condition in which the vanes 38 contact with the opposed walls 66*b* as shown in FIG. 2.

A fluid supplying device 90 is comprised of a changeover valve 91, a fluid pump 92 and a controller 93. In this embodiment, the changeover valve 91 is an electromagnetic valve which is 4 parts—3 positions type. The fluid pump 92 is driven by the engine and are discharged the fluid (-oil) for lubricating the engine. The pump 92 may be a pump for lubricating the engine. The passage 16 communicates with an A port of the changeover valve 91 and the passage 18 communicates with a B port of the changeover valve 91. A P port of the changeover valve 91 communicates with a discharge portion the fluid pump 92 and a R port of the changeover valve 91 communicates with a reservoir 94. The position of the changeover valve 91 is controlled by the controller 93 so that a first condition in which the discharged fluid from the pump 92 is supplied to the passage 16 and in which the passage 18 communicates with the reservoir 94, a second condition in which the communication between the passages 16, 18 and the pump 92 and the reservoir 94 are interrupted, respectively and in which the discharged fluid from the pump 92 is supplied to the reservoir 94 and a third condition in which the discharged fluid from the pump 92 is supplied to the passage 18 and in which the passage 16 is communicated to the reservoir 94 are selectively obtained. The controller 93 controls the above conditions of the changeover valve 91 based on parameter signals which are an engine speed, an amount of opening of a throttle valve (not shown) and so on.

The operation of the valve timing control device having the above structure will now be described.

With the starting of the engine, the rotational torque is transmitted from the crank shaft 48 to the housing member 40 through the chain 47 and the gear portion 46 and thereby, the housing member 40 is rotated clockwise in FIG. 2 and FIG. 3. The rotational torque of the housing member 40 is transmitted to the rotor 22 via the vanes 38. Then, the cam shaft 12 is rotated clockwise in FIG. 2 and FIG. 3 and the valves (not shown) are opened and closed. At that point, in this embodiment, since the changeover valve 91 is in the first condition, the rotational torque of the housing member 40 is transmitted to the rotor 22 via the piston pin 76.

When the changeover valve 91 is changed to the third condition, the pressurized fluid is supplied from the pump 92 to the second pressure chambers 64 via the passage 18, the central hole 20, the hole 34, the space 56 and the second passages 62. At that time, the pressurized fluid is applied to the fitting hole 78 via the hole 82 and then the piston pin 76 is moved toward the radial hole 72 against the urging force of the spring 74. As a result, the engagement between the housing member 40 and the rotor 22 via the piston pin 76 is released and the relative movement between the housing member 40 and the rotor 22 is allowed. Then, the vanes 38 and the rotor 22 are rotated clockwise relative to the housing member 40 in FIG. 2 and FIG. 3 until the vanes 64 are in contact with the walls 66*a*. Thereby, the valve timing control device is in the position of the maximum advanced condition in which the angular phase of the cam shaft 12 is advanced relative to that of the crank shaft 48 by a predetermined maximum value. In this condition, when the pressurized fluid is supplied from the pump 92 to the first pressure chambers 66 by the changeover valve 91 changed to the first condition via the passage 16 and the first passages 58, the vanes 38 and the rotor 22 are rotated counterclockwise relative to the housing member 40 in FIG. 2 and FIG. 3 until the vanes 38 are contacted with the walls 66*b*. Thereby, the valve timing control device is in the position of the maximum retarded condition in which the angular phase of the cam shaft 12 is retarded relative to that of the crank shaft 48 by a predetermined maximum value. Now, depending on the manner in which the control of the changeover valve 91 in executed, the vanes 38 can be stopped in any position (intermediate advanced position) between the maximum advanced position and the maximum retarded position. This requires that a balance be achieved between the fluid pressure of the first pressure chambers 60 and the fluid pressure of the second pressure chambers 64 when the vanes 38 have achieved an arbitrary position. The amount of the advance can therefore be set to any value between a zero level and a maximum level.

As mentioned above, the opening and closing timing of the valves (not shown) driven by the cam shaft 12 is adjusted and the angular phase difference between the crank shaft 48 and the cam shaft 12 is adjusted.

Further, in this embodiment, the circular groove 28 is formed on one surface of the flange portion 22*a* of the rotor 22 which is opposite to the end surface 26 of the cam shaft 12. Thereby, since the requisite sealing surface for the circular groove 28 is ensured by one surface of the flange portion 22*a* and the end surface 26, the axial length of the cylindrical projecting portion 23 may be shortened. Further, since the cylindrical portion 30 on which the housing member 40 is mounted is formed on the rotor 22, the head portion 32 of the bolt 24 may be disposed in the cylindrical portion 30. Accordingly, the axial length of the end of the cam shaft 12 which is projected from the cylinder head 14 may be reduced and therefore the engine may be reduced in size. Furthermore, the hole 34 of the bolt 24 and the space 56 are used as a part of the passage for supplying the fluid to the second pressure chambers 64. Therefore, the restricted space of the valve timing control device may be used efficiently. Furthermore, the housing member 40, the front plate 44 and the rear plate 42 are united by the bolts 48 which are screwed from the side of the rear plate 44 being adjacent to the cylinder head 14. Therefore, since the bolts 48 cannot be removed before the bolt 24 is removed, the bolts 48 are prevented from being carelessly removed during the maintenance of the engine.

Figure 4:
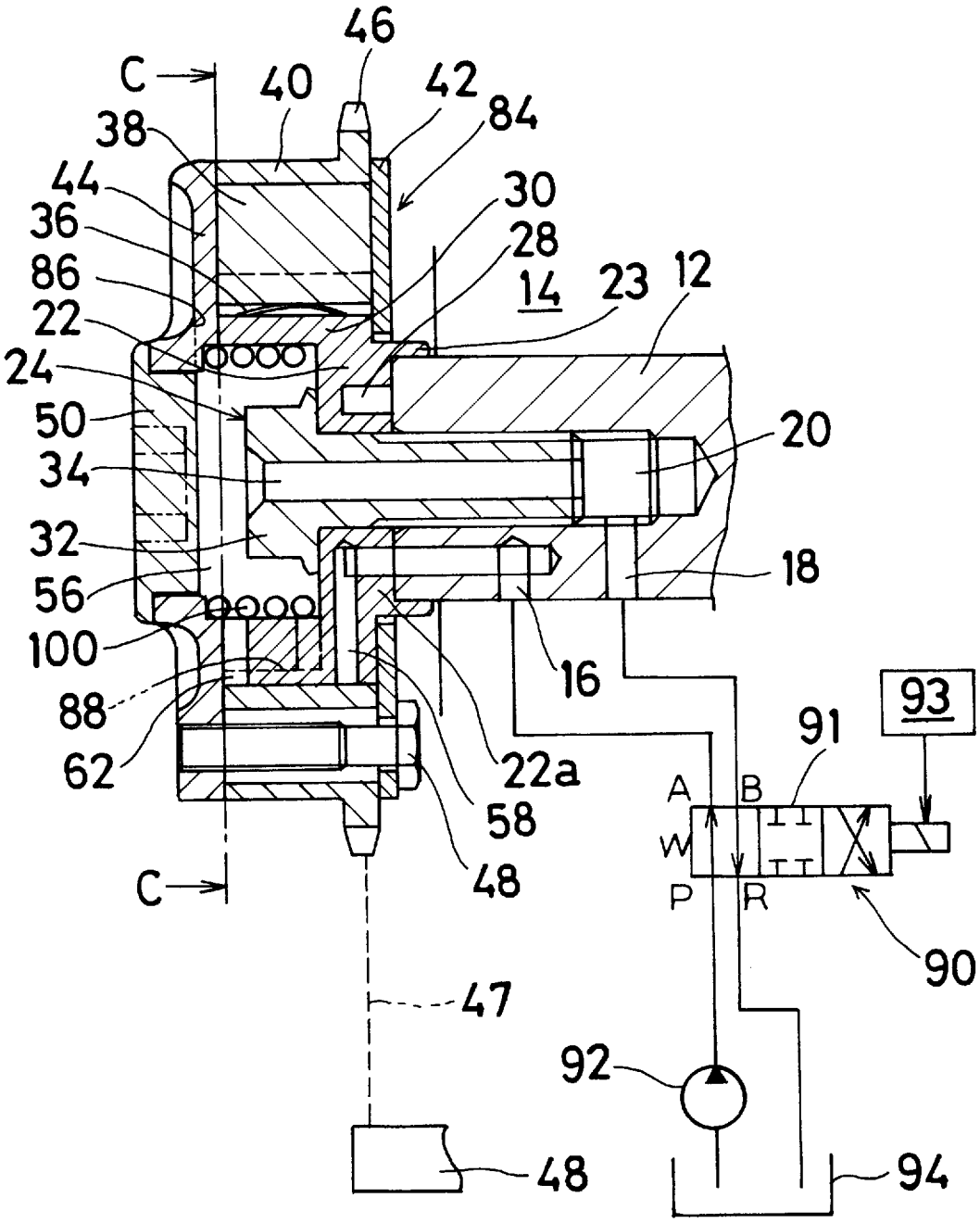
FIG. 4 shows a sectional view of an second embodiment of a valve timing control device in accordance with the present invention.
Figure 5:
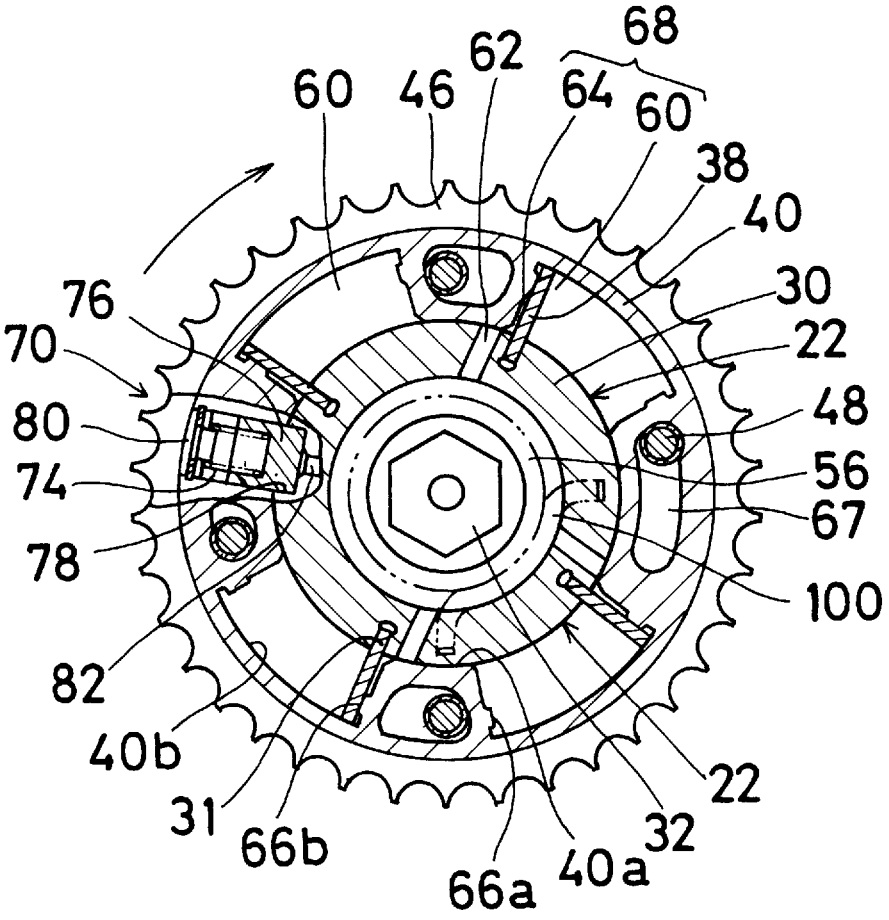
FIG. 5 shows a cross-sectional view taken on line C—C of FIG. 4.

FIG. 4 and FIG. 5 show a second embodiment of a valve timing control device 84. In FIG. 4 and FIG. 5, the same parts as compared with FIG. 1 to FIG. 3 are identified by the same reference numerals.

Referring to FIG. 4 and FIG. 5, a coil spring 100 is disposed in the cylindrical portion 30 of the rotor 22. One end of the coil spring 100 is engaged with a hole 86 which is formed on the front plate 44. The other end of the coil spring 100 is engaged with an axial hole 88 which is formed on the inner circumference of the cylindrical portion 30. Thereby, the coil spring 100 normally urges the rotor 22 and the vanes 38 (the cam shaft 12) clockwise, namely, toward the advance direction. In particular, it is an advantageous method for controlling the valve timing of exhaust valves that the cam shaft 12 is normally urged to the advance direction. The cam shaft 12 normally receives reaction to the retard direction. When the cam shaft 12 is a cam shaft for exhaust valves, the open and close timing of the exhaust valves is retarded. In particular, when the open and close timing of the exhaust valves is retarded at the starting of the engine, the exhaust valves and the intake valves open simultaneously and mixture gas is discharged without combustion. Therefore, there exists the danger that starting the engine may become difficult and that the atmosphere may be contaminated. In this embodiment, these drawbacks are overcome. Further, according to this embodiment, since the coil spring 100 in disposed in the space 56 and is always in the fluid (oil), the coil spring 100 is prevented from oxidizing and its torsional operation is maintained.

In the above mentioned embodiments, the present invention is applied to the type of the valve timing control device shown in U.S. Pat. No. 4,858,572. However, it is possible to apply the present invention to another type of the valve timing control device shown in Japanese utility-model application laid-open publication No. 6(1994)-14403.

As mentioned above, according to the present invention, since it is not necessary to form the passages for supplying the fluid to the angular phase converting mechanism on the outer circumference of the cam shaft, it is able to reduce the axial length of the end of the cam shaft which is projected from the cylinder head may be reduced and therefore the size of the engine may be decreased.

The principles, a preferred embodiment and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve timing control device comprising:

a rotor fixed on a cam shaft and having a circular groove opposing to an end surface of the cam shaft, the circular groove communicating to a passage formed in the cam shaft, a housing member disposed so as to surround the rotor, an angular phase converting mechanism disposed between the rotor and the housing member so as to be able to transmit the rotational torque from the housing member to the rotor and so as to be able to give the angular phase difference between the rotor and the housing member and fluid supplying means for supplying fluid under pressure to the angular phase converting mechanism through the passage and the circular groove.

2. A valve timing control device in claim 1, wherein a first passage which is communicated to the angular phase converting mechanism via the circular groove and a second passage which is communicated to the angular phase converting mechanism via a supply passage formed in the rotor are formed in the cam shaft and the angular phase converting mechanism is operated in response to the difference between the fluid pressures in the first and second passages.

3. A valve timing control device in claim 2, wherein the angular phase converting mechanism includes a chamber defined between the housing member and the rotor and having a pair of circumferentially opposed walls and a vane mounted on the rotor and extended outwardly therefrom in the radial direction into the chamber so as to divide the chamber into a first pressure chamber and a second pressure chamber, and wherein the fluid supplying means supplies fluid under pressure to at least a selected one of the first pressure chamber and the second pressure chamber.

4. A valve timing control device in claim 3, wherein hollow portions are formed in the walls.

5. A valve timing control device in claim 2, wherein the rotor is fixed to the cam shaft by a bolt which has a penetrating hole as the supply passage.

6. A valve timing control device in claim 5, wherein the rotor is provided with a cylindrical portion which extends relative to the cam shaft and the housing member is rotatably mounted on the cylindrical member.

7. A valve timing control device in claim 6, wherein an inner space of the cylindrical portion of the rotor constitutes a part of the supply passage.

8. A valve timing control device in claim 7, wherein an elastic member which urges the rotor in the rotational direction of the cam shaft is disposed in the cylindrical portion of the rotor.

9. A valve timing control device in claim 2, wherein the fluid supplying means includes a fluid pump from which fluid under pressure is supplied, an electromagnetic changeover valve connected to the fluid pump and alternately connected to the first passage and the second passage and a controller for controlling the control position of the changeover valve.

10. A valve timing control device in claim 3, wherein a plural number of the chambers are defined between the housing member and the rotor and a plural number of the vanes are mounted on the rotor so as to divide the chambers into the first pressure chambers and the second pressure chambers, respectively.

* * * * *